US011767655B2

(12) United States Patent
Killniak

(10) Patent No.: US 11,767,655 B2
(45) Date of Patent: Sep. 26, 2023

(54) CUTTING ASSEMBLY MOUNTED ON REAR OF MOULDBOARD

(71) Applicant: 102078986 SASKATCHEWAN INC., Yorkton (CA)

(72) Inventor: Chad Killniak, Yorkton (CA)

( * ) Notice: Subject to any disclaimer, the term of this patent is extended or adjusted under 35 U.S.C. 154(b) by 414 days.

(21) Appl. No.: 16/995,945

(22) Filed: Aug. 18, 2020

(65) Prior Publication Data

US 2021/0062462 A1 Mar. 4, 2021

(30) Foreign Application Priority Data

Aug. 30, 2019 (CA) ..... CA 3053702

(51) Int. Cl.
*E02F 3/815* (2006.01)
*E02F 9/28* (2006.01)

(52) U.S. Cl.
CPC ..... *E02F 3/8152* (2013.01); *E02F 9/2841* (2013.01)

(58) Field of Classification Search
CPC ..... E02F 3/8152; E02F 3/2841; E02F 9/2808; E02F 9/2816; E02F 9/2841
USPC ..... 172/701.3
See application file for complete search history.

(56) References Cited

U.S. PATENT DOCUMENTS 2,219,160 A * 10/1940 White ..... E02F 3/8152 172/777
2,396,739 A * 3/1946 McCauley ..... E02F 3/8152 172/777
2,475,710 A * 7/1949 McCauley ..... E02F 3/8152 172/197
2,494,225 A * 1/1950 Blake ..... E02F 3/8152 172/136
2,510,445 A * 6/1950 Way ..... E02F 3/8155 172/710
2,700,833 A * 2/1955 Small ..... E02F 3/8152 172/710
3,124,888 A * 3/1964 Jeffrey ..... E02F 3/8152 172/764
3,888,027 A * 6/1975 Toews ..... E02F 3/8152 172/701.3
4,346,528 A * 8/1982 Shwayder ..... E02F 9/285 37/270
4,448,260 A * 5/1984 Harmsen et al. ..... E02F 3/8155 172/136
4,753,299 A 6/1988 Meyers
(Continued)

*Primary Examiner* — Thomas B Will
*Assistant Examiner* — Joel F. Mitchell
(74) *Attorney, Agent, or Firm* — Ryan W. Dupuis; Kyle R. Satterthwaite; Ade & Company Inc.

(57) ABSTRACT

A cutting assembly for mounting cutting tips on a mouldboard of a motor grader has a cutter body including a forward mounting face for mounting along a rear face of the mouldboard simultaneously with a continuous blade body supported along the front face of the mouldboard. A row of sockets in the cutter body are arranged to support cutting tips respectively therein. The cutter body is configured to support the cutting tips on the mouldboard such that (i) the cutting tips are raised relative to the lower blade edge of the blade body in a normal working position of the mouldboard, and (ii) the cutting tips protrude below the lower blade edge of the blade body in a cutting position of the mouldboard in which the lower blade edge of the blade body is tilted about the tilt axis upwardly and forwardly in relation to the normal working position.

17 Claims, 4 Drawing Sheets

(56) References Cited

U.S. PATENT DOCUMENTS

| | | | | |
|---|---|---|---|---|
| 4,883,129 | A * | 11/1989 | Lonn et al. | E21C 35/183 172/701.3 |
| 5,813,474 | A * | 9/1998 | Manway | E01H 5/061 172/701.3 |
| 6,202,327 | B1 * | 3/2001 | Fuller et al. | E01H 5/12 37/219 |
| 6,860,039 | B2 * | 3/2005 | Schultz et al. | E01H 5/063 37/234 |
| 7,661,210 | B2 * | 2/2010 | Shepherd | E01H 5/068 37/231 |
| 7,836,615 | B2 * | 11/2010 | Winter | E01H 5/066 37/270 |
| 2007/0215367 | A1 * | 9/2007 | Smart et al. | E01H 5/061 172/695 |
| 2018/0038065 | A1 | 2/2018 | Hunt | |
| 2020/0141094 | A1 * | 5/2020 | Parzynski et al. | E02F 9/2808 |

* cited by examiner

CUTTING ASSEMBLY MOUNTED ON REAR OF MOULDBOARD

This application claims foreign priority benefits from Canadian Patent Application No. 3,053,702, filed Aug. 30, 2019.

FIELD OF THE INVENTION

The present invention relates to a cutting assembly comprising a cutter body arranged to be releasably fastened onto a rear side of a mouldboard of a motor grader and including a plurality of sockets in the cutter body to releasably receive respective cutting tips for scraping the ground in the sockets.

BACKGROUND

Conventionally, motor graders are provided with a mouldboard having a blade body replaceably secured along the lower edge of the mouldboard using bolts. The blade body has a lower cutting edge which is continuous across the width of the blade; however, the continuous cutting edge prevents the blade from penetrating upper compacted layers of a road surface so that the blade tends to skid along the road surface rather than effectively scrape the road.

An alternative to a blade body with a continuous lower cutting edge is a scraper body with a row of sockets therein which can be fastened to the front side of the mouldboard in place of the blade body. The sockets support respective cutting tips therein which are typically tapered or have sharpened edges with hardened material such as carbide at the lower working edge thereof so that the cutting edges of the cutting tips are spaced apart and discontinuous along the lower portion of the mouldboard for more effective penetration into compacted materials on the ground. U.S. Pat. No. 4,753,299 by Meyers and US patent application publication 2018/0038065 by Hunt disclose examples of cutting attachments which can be secured to the front face of a mouldboard in place of a continuous edge blade body. Use of such cutting attachments requires the operator to undergo a time-consuming removal of the continuous edge cutting blade and attachment of the cutting attachment to perform aggressive scraping when required, but then must replace the continuous edge cutting blade to effectively level the ground surface once the desired degree of scraping has been performed.

SUMMARY OF THE INVENTION

According to one aspect of the invention there is provided a cutting assembly for mounting cutting tips on a mouldboard of a motor grader including a frame supported on wheels for rolling movement along the ground in forward working direction and a mouldboard body that is elongated in a longitudinal direction of the mouldboard and that is tiltable relative to the frame about a tilt axis oriented in the longitudinal direction of the mouldboard such that the tilt axis is transverse to the forward working direction and a blade body fastened along a lower portion of the mouldboard having a lower blade edge for engaging the ground, the cutting assembly comprising:

- a cutter body including (i) a forward mounting face arranged for mounting along a rear face of the mouldboard and (ii) fastener apertures arranged to receive fasteners to fasten the cutter body against the rear face of the mouldboard; and
- a row of sockets in the cutter body that are arranged to support the cutting tips respectively therein such that:

- (i) the cutting tips are raised relative to the lower blade edge of the blade body in a normal working position of the mouldboard; and
  - (ii) the cutting tips protrude below the lower blade edge of the blade body in a cutting position of the mouldboard in which the lower blade edge of the blade body is tilted about the tilt axis upwardly and forwardly in relation to the normal working position.

By providing a cutter body which can be mounted along the rear face of the mouldboard, the cutting assembly can be used in addition to a continuous edge cutting blade. More particularly the cutting assembly act as a scraper or cutter available to the grader operator instead of needing to change blades on the mouldboard to fit the application. Previously it would be normal for an operator to change their cutting edges from a continuous edge blade body to a cutting assembly that accepts carbide tips then returned to the jobsite to finish the work. With the cutting assembly of the present invention, it is possible to do both jobs while staying at the jobsite. The operator can use either their conventional continuous edge blade or the cutting assembly of the present invention depending upon the rotation of the mouldboard. This allows for cost and time savings for any operator. The rear mounted cutting assembly is able to be used in any grading application, but suits itself best for removal of ice or hardpacked snow in the winter and washboard or surface rocks on roadways in the summer.

According to a second aspect of the present invention there is provided a motor grader comprising:

- a frame supported on wheels for rolling movement along the ground in a forward working direction;
- a mouldboard body supported on the frame that is elongated in a longitudinal direction of the mouldboard and that is tiltable relative to the frame about a tilt axis oriented in the longitudinal direction of the mouldboard such that the tilt axis is transverse to the forward working direction;
- a blade body fastened along a lower portion of the mouldboard having a lower blade edge for engaging the ground;
- a cutting assembly comprising:
  - a cutter body including a forward mounting face mounted along a rear face of the mouldboard and fastener apertures receiving fasteners therethrough that fasten the cutter body against the rear face of the mouldboard; and
  - a plurality of cutting tips supported within respective sockets along a row in the cutter body such that:
  - (i) the cutting tips are raised relative to the lower blade edge of the blade body in a normal working position of the mouldboard; and
  - (ii) the cutting tips protrude below the lower blade edge of the blade body in a cutting position of the mouldboard in which the lower blade edge of the blade body is tilted about the tilt axis upwardly and forwardly in relation to the normal working position.

Preferably the sockets are oriented so as to be arranged to (i) support the cutting tips raised in elevation relative to the lower blade edge of the blade body when the blade body is substantially vertical in orientation, and (ii) support the cutting tips protruding below the lower blade edge of the blade body when the blade body is sloped upwardly and rearwardly from the lower blade edge thereof.

When each socket is arranged to receive one of the cutting tips therein along an axis of the socket, preferably the axis of each socket is oriented at a slope of between 0 degrees and 20 degrees from the forward mounting face of the cutter body. More preferably, the axis of each socket is oriented at a slope of between 0 degrees and 10 degrees from the forward mounting face of the cutter body.

When each socket is arranged to receive one of the cutting tips therein along an axis of the socket and each fastener aperture is arranged to receive a fastener therein along an axis of the fastener aperture; preferably the axes of the sockets are oriented at a slope of between 70 degrees and 90 degrees from the axes of the fastener apertures. More preferably, the axes of the sockets are oriented at a slope of between 80 degrees and 90 degrees from the axes of the fastener apertures.

Each fastener aperture may be elongated in a vertical direction so as to be elongated transversely to a horizontal direction of said row of the sockets.

When used with cutting tips each having a sprung retainer member which is resiliently supported on a stem of the cutting tip, preferably each socket includes an annular groove formed therein so as to be arranged to receive the sprung retainer member of the respective cutting tip when the stem of the cutting tip is received within the socket to selectively retain the cutting tip within the cutter body.

When the cutting assembly is supported on the motor grader and the cutting tips are mounted in the sockets of the cutter body, the mouldboard is preferably movable about the tilt axis between (i) the normal working position in which the cutting tips are raised relative to the lower blade edge of the blade body and (ii) the cutting position in which the cutting tips protrude below the lower blade edge of the blade body.

Preferably the fastener apertures in the cutter body are arranged for alignment with fastener apertures in the mouldboard and the blade body such that the blade body and the cutter body can be mounted onto the mouldboard using a common set of fasteners.

According to a further aspect of the present invention there is provided a method of operating a motor grader including a frame supported on wheels for rolling movement along the ground in forward working direction and a mouldboard body that is elongated in a longitudinal direction of the mouldboard and that is tiltable relative to the frame about a tilt axis oriented in the longitudinal direction of the mouldboard such that the tilt axis is transverse to the forward working direction, the method comprising:

- providing a blade body fastened along a lower portion of the mouldboard at a front side of the mouldboard such that a lower blade edge of the blade body is arranged for engaging the ground;
- providing a cutter body fastened at a rear side of the mouldboard, the cutter body including a forward mounting face mounted against a rear face of the mouldboard and fastener apertures receiving fasteners therethrough that fasten the cutter body against the rear face of the mouldboard;
- providing a plurality of cutting tips supported within respective sockets along a row in the cutter body;
- pivoting the mouldboard relative to the frame about the tilt axis between (i) a normal working position in which the cutting tips are raised relative to the lower blade edge of the blade body, and (ii) a cutting position in which the cutting tips protrude below the lower blade edge of the blade body.

BRIEF DESCRIPTION OF THE DRAWINGS

Some embodiments of the invention will now be described in conjunction with the accompanying drawings in which.

In the drawings like characters of reference indicate corresponding parts in the different figures.

DETAILED DESCRIPTION

Figure 1:
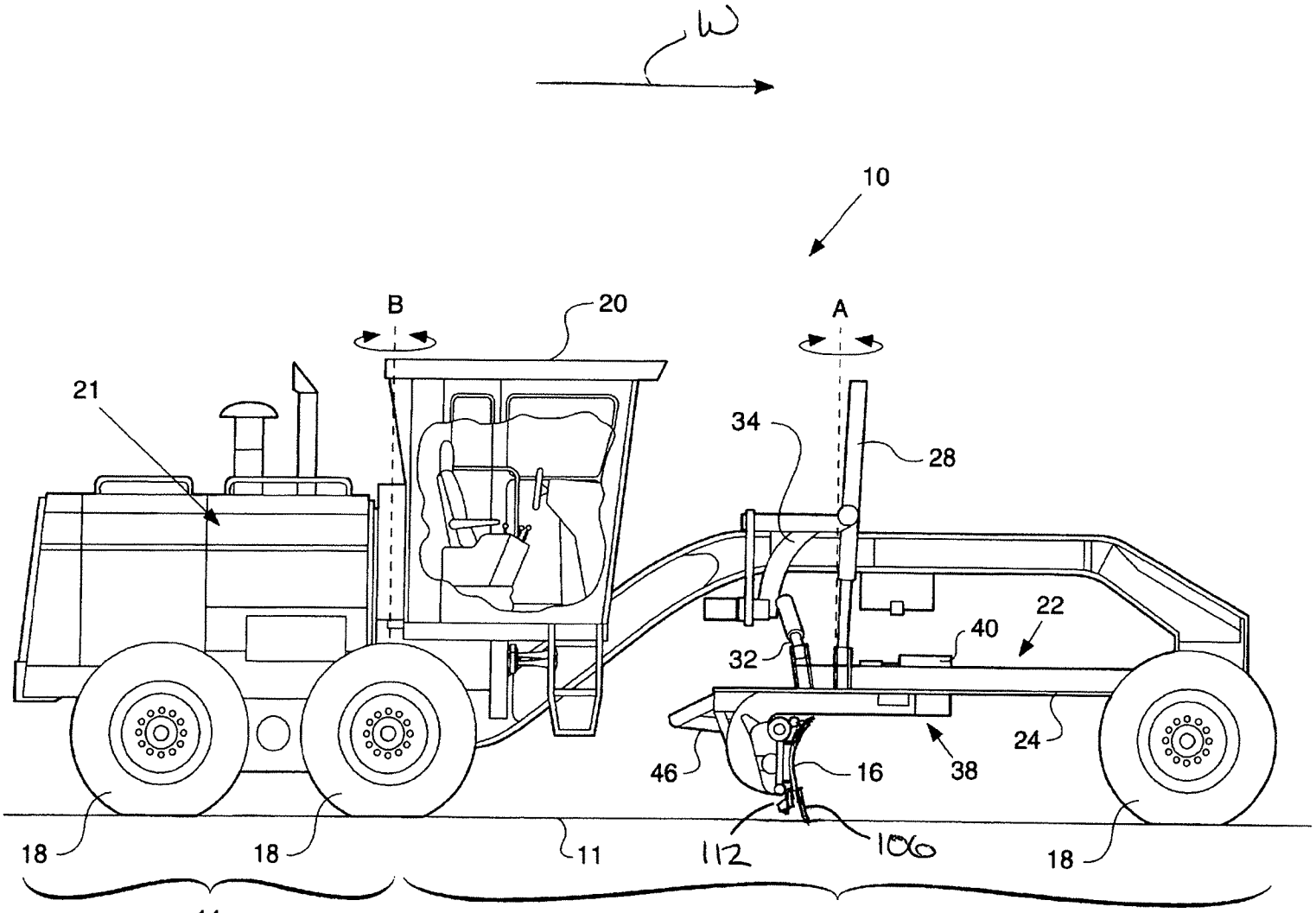
FIG. 1 is a side elevational view of a motor grader upon which the cutting assembly is supported.

Referring to the accompanying figures, there is illustrated a motor grader cutting assembly generally indicated by reference numeral 100. The cutting assembly 100 is particularly suited for use on a motor grader 10.

To assist in the understanding of the operation of the cutting assembly 100, the general configuration and operation of an exemplary motor grader 10 will first be described. The motor grader 10 according to FIG. 1 is generally arranged for moving small quantities of material laterally to one side of the grader as the grader moves in a forward working direction W across the ground 11. In some instances, this may involve the leveling of ground by displacing earth or aggregate material used on roadways laterally to one side of the grader; however, in other instances use of the grader may involve displacing ice and snow laterally to one side of a roadway as the grader is moved forwardly along the roadway.

The motor grader 10 includes a front frame 12 supported on wheels 18 at the forward end, a rear frame 14 supported on wheels 18 at the rear end, and a mouldboard 16 supported on the front frame at an intermediate location between the wheels 18 of the front and rear frames. An operator cab 20 is also supported on the front frame rearwardly of the mouldboard 16 to receive an operator therein for operating many controls within the cab which are necessary to operate the motor grader 10. An engine 21 is typically supported on the rear frame behind the operator cab and provides power for driving and operating the components of the motor grader. The engine typically drives a hydraulic pump of a hydraulic system which supplies hydraulic fluid to various operating systems of the motor grader in a conventional manner.

A linkage assembly 22 supports the mouldboard 16 on the forward frame such that the mouldboard 16 can be moved to a variety of different positions relative to the frame of the motor grader 10. The linkage assembly 22 includes a drawbar 24 mounted to the front frame 12 with a ball joint so that the position of the drawbar 24 can be adjusted. A right lift cylinder 28, a left lift cylinder (not shown) and a centre shift cylinder 32 are operatively connected between the drawbar 24 and the front frame to control the position of the drawbar 24. A coupling 34 connects the three cylinders to the front frame 12 which can be moved during blade repositioning but is typically held stationary when moving material with the grader.

The mouldboard 16 includes a main body 102 which is elongated in a longitudinal direction of the mouldboard, corresponding to a lateral direction of the grader, to span the full width of the mouldboard. The main body 102 also spans the majority of the height of the mouldboard. A lower flange portion 104 protrude downwardly from a bottom edge of the main body 102 along the full length thereof in which a leading face of the flange portion is recessed rearwardly relative to the leading face of the main body 102 which primarily defines the forward working face of the mouldboard for moving material to the side of the grader.

The mouldboard 16 also includes a blade body 106 supported on the front side of the flange portion 104 of the main body 102 in which the rearward offset of the flange portion is approximately equal to a thickness of the plate forming the blade body 106 such that a leading face of the blade body is substantially flush with the leading face of the main body 102 of the mouldboard in the illustrated embodiment. The blade body protrudes below the bottom edge of the flange portion 104 of the main body 102 to a bottom edge of the blade body which defines a continuous cutting edge 108. A plurality of fastener apertures are provided at evenly spaced positions along the length of the blade body near the upper portion thereof for alignment with corresponding apertures in the flange portion 104 of the main body 102 of the mouldboard 16 so that fasteners 110 can extend axially through the apertures to selectively fasten the blade body to the lower flange portion of the mouldboard.

The blade height of the cutting edge 108 of the blade body 106 of the mouldboard 16 with respect to the surface of the ground 11 below the motor grader is controlled primarily with the right and left lift cylinders when operated together. By controlling the left and right lift cylinders independently, an angle of a bottom cutting edge 108 of the mouldboard relative to the surface of the earth 11 can be adjusted about a forward axis oriented generally in the forward working direction. The centre shift cylinder 32 can be operated to displace the drawbar 24 and all components counted on the end of the drawbar in a lateral direction of the grader relative to the front frame 12, which corresponds to the longitudinal direction of the mouldboard. This lateral displacement is commonly referred to as drawbar side shift or circle centre shift.

A large flat plate referred to as a yoke plate is included at the rear of the drawbar 24 to support a large gear under the yoke plate commonly referred to as a circle 38. A hydraulic motor defining a circle drive 40 is used to rotate the circle 38 in a manner referred to as circle turn, for pivoting the mouldboard 16 about a generally vertical axis to define a blade cutting angle relative to the forward working direction.

A bracket is used to mount the mouldboard 16 to a hinge on the circle 38 which defines a generally laterally oriented tilt axis about which the mouldboard is tilted.

The tilt axis extends in the longitudinal direction of the mouldboard. A blade tilt cylinder 46 is used to pivot the bracket supporting the mouldboard 16 relative to the forward frame forward or rearward for adjusting the angular orientation or blade tip of the mouldboard about the tilt axis.

In a normal working position of the blade body 106 at the leading face of the mouldboard 16, the plate forming the blade body 106 may be oriented to be near vertical and orientation or may extend upwardly from the bottom cutting edge 108 at a slight forward inclination or a slight rearward inclination depending upon the desired aggressiveness of the cutting action of the blade body 106 relative to the ground.

The mouldboard is also mounted on the bracket using a sliding joint which allows the mouldboard 16 to be displaced side to side in the longitudinal direction of the mouldboard relative to the bracket or the circle 38 to adjust the blade side shift of the mouldboard. A side shift cylinder (not shown) is operatively connected between the mouldboard and the bracket to control the blade side shift.

Turning now more particularly to the configuration of the cutting assembly 100, the cutting assembly 100 generally comprises a cutter body 112 having a mounting portion 114 for mounting at the rear side of the mouldboard, and a cutting portion 116 used for supporting a plurality of cutting tips 118 therein as described in further detail below.

Figure 2:
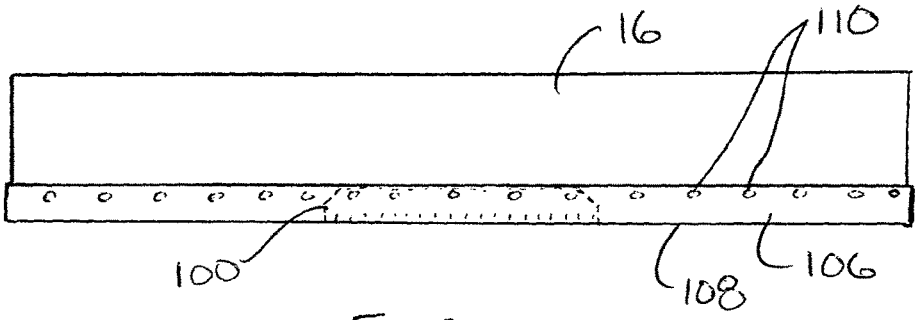
FIG. 2 is a front elevational view of the mouldboard of the motor grader supporting both a continuous edge blade on the front face of the mouldboard and the cutting assembly of the present invention on the rear face of the mouldboard according to a first embodiment of the cutting assembly.

The mounting portion 114 comprises a flat plate having a flat front mounting face 120 arranged for parallel abutment flat against a rear face at the rear side of the mouldboard 16. The opposing rear side of the mounting portion 114 is also flat. The plate forming the mounting portion is elongated in the longitudinal direction of the mouldboard in the mounted position while having an overall length that spans only part of the length of the mouldboard. As shown in FIG. 2, the cutter body 112 is typically mounted centrally along the overall length of the mouldboard.

A row of fastener apertures 122 are provided in the upper mounting portion 114 in which the row extends generally horizontally in parallel relation adjacent the top edge of the upper mounting portion. Each aperture extends fully through the cutter body from the rear face to the front face thereof along a respective aperture axis 123 oriented generally perpendicularly to the front and rear faces of the mounting portion. The apertures are suitably spaced apart from one another in the longitudinal direction for alignment with corresponding fastener apertures in the mouldboard and the blade body. In this manner a common set of fasteners 110 can be used to extend fully through both the blade body 106 and the cutter body 112 at the front and rear sides of the mouldboard therebetween.

Each fastener aperture 122 is elongated in a vertical direction that is perpendicular to longitudinal direction of the mouldboard. In this manner the precise height and angular orientation of the cutter body is somewhat adjustable relative to the mouldboard and the blade body 106 mounted thereon.

Figure 3:
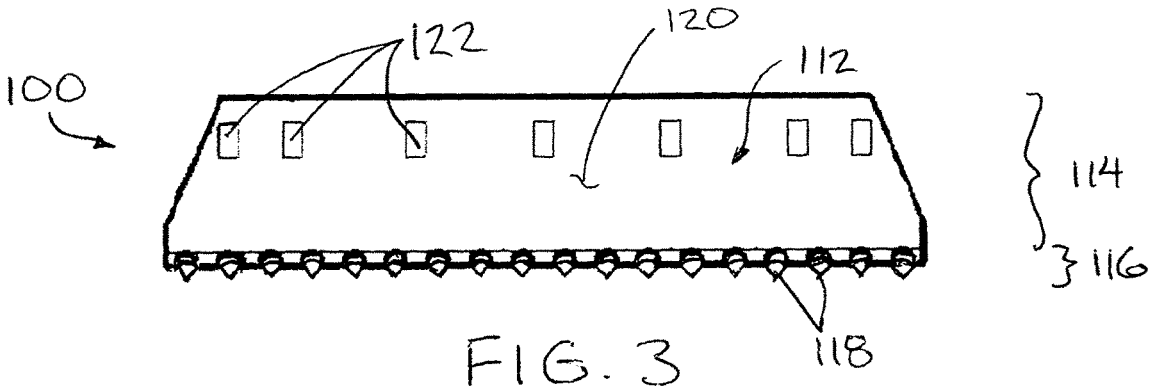
FIG. 3 is a front elevational view of the cutter body of the cutting assembly with the cutting tips removed therefrom according to the first embodiment of FIG. 2.
Figure 8:
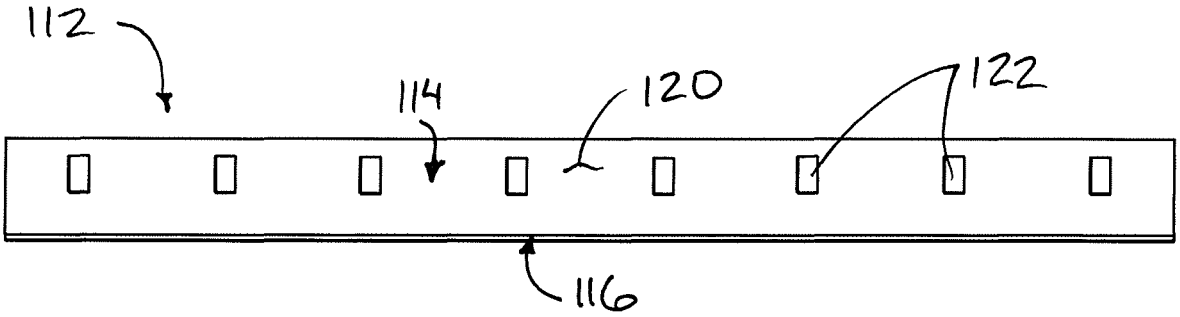
FIG. 8 is a front elevational view of the cutter body according to the second embodiment of FIG. 7.

In some embodiments, opposing ends of the cutter body are tapered upwardly and inwardly from a bottom edge to the top edge thereof as illustrated in FIG. 3. In this manner the top edge of the upper mounting portion is shorter in the longitudinal direction than the bottom edge thereof while both ends of the top edge are recessed longitudinally inwardly relative to the remainder of the cutter body therebelow. Alternatively, the cutter body may be rectangular in shape as illustrated in FIG. 8.

The cutting portion 116 of the cutter body extends the full length of the bottom edge of the cutter body to define the overall length of the cutter body in the longitudinal direction. The cutting portion 116 of the cutter body is angularly offset from the upper mounting portion 114 such that the lower cutting portion protrudes rearwardly from the bottom edge of the mounting portion 114 at a rearward and downward slope according to the first embodiment shown in FIG.

Figure 7:
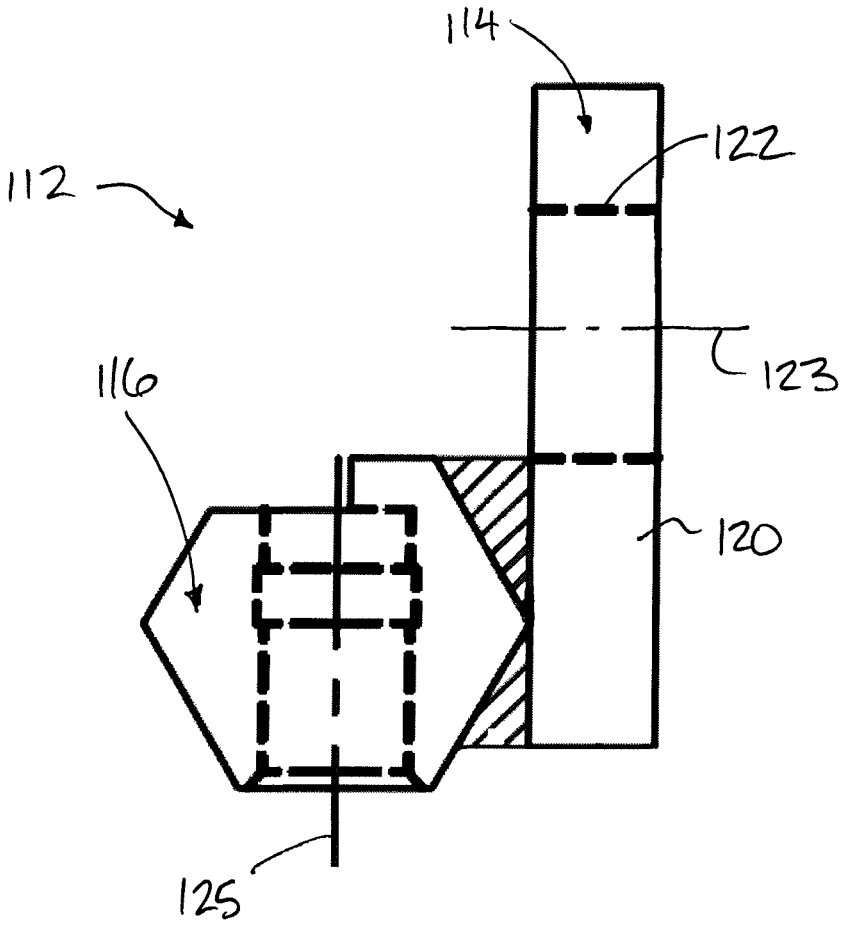
FIG. 7 is an end view of the cutter body of the cutting assembly according to a second embodiment, shown with the cutting tips removed therefrom.

4. The cutting portion 116 is thus spaced rearwardly behind the front mounting face 120 by the thickness of the plate forming the mounting portion 114. Alternatively, the cutting portion 116 protrudes perpendicularly rearward from the mounting portion 120 according to the second embodiment as shown in FIG. 7.

The cutting portion 116 locates a longitudinally extending row of sockets 124 therein. Each socket extends upwardly and rearwardly along a respective socket axis 125 from an open end of the socket at a bottom of the cutter body so that each socket is arranged to receive a respective one of the cutting tips 118 therein.

Each cutting tip 118 includes a stem 128 having a generally cylindrical outer surface. A sprung retainer member 130 is mounted on the body of the stem so as to be biased from a released position in which the retainer member is substantially retracted relative to the outer surface of the stem and a locked position in which the retainer member protrudes outwardly from the outer surface of the stem. A head 132 is supported at one end of the stem 128 which is enlarged in diameter relative to the stem to define an annular shoulder at the junction between the head and the stem. The head tapers inwardly in the longitudinal direction extending away from the stem so as to be tapered towards an apex at the free end of the cutting tip. The free end of the head 132 supports an insert 134 of wear resistant material therein, for example a carbide material which is harder than the material of the remainder of the head 132 and the stem 128.

Each socket 124 includes a main cylindrical portion sized to receive the stem 128 therein and an annular groove 136 at an intermediate location along the socket. The cutting tip is mounted within the socket such that the shoulder at the base of the head 132 abuts the bottom face of the cutter body while the stem fits within the socket and the sprung retainer member 130 aligns with the annular groove 136 to selectively retain the cutting tip mounted within the socket.

Figure 4:
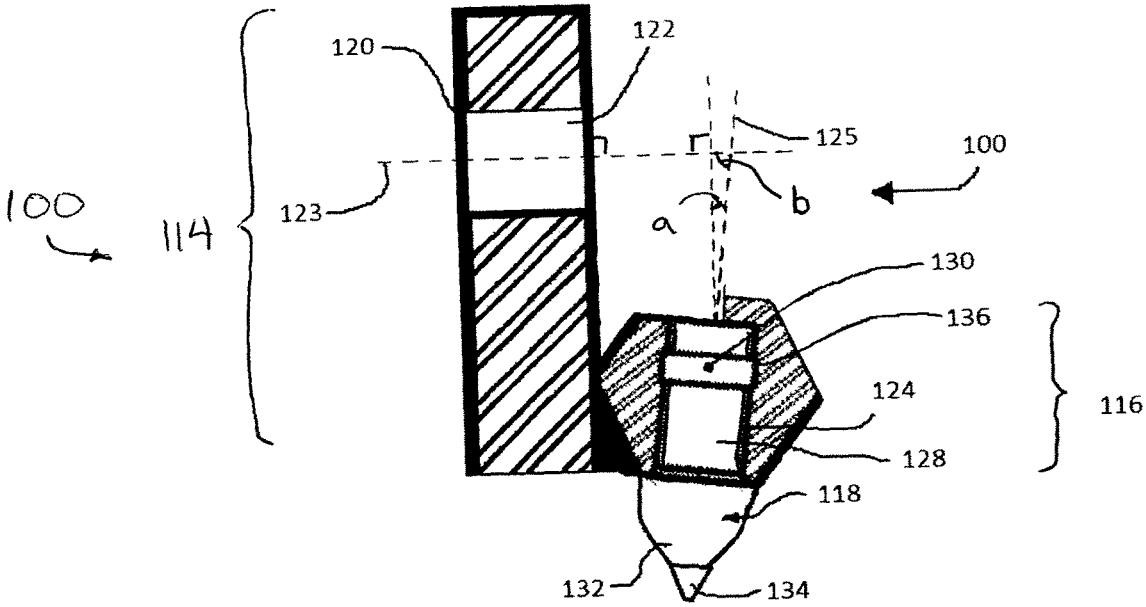
FIG. 4 is a sectional view along the line 4-4 in FIG. 3.

All of the socket axes lie in a generally common plane. In the first embodiment, as shown in FIG. 4, the common plane of the socket axes is oriented at an angle 'a' of approximately 5 degrees relative to a plane of the front mounting face 120 of the upper mounting portion of the cutter body. This orientation of the sockets results in the socket axes also being oriented at an angle 'b' of approximately 85 degrees from a common plane locating the aperture axes therein.

In further embodiments, the cutting tips can be effectively supported so that the socket axes lie at an angle of between 0 degrees and 20 degrees from the front mounting face 120, but an angle within the range of 0 to 10 degrees is preferred. The cutting tips can thus effectively be supported so that the socket axes lie at an angle of between 70 and 90 degrees from a common plane locating the aperture axes therein, but an angle within the range of 80 and 85 degrees is represented in FIG. 4.

According to a preferred embodiment shown in FIG. 7, the socket axes are oriented parallel to the front mounting face 120 of the cutter body. This orientation of the sockets results in the socket axes also being oriented at an angle 'b' of approximately 90 degrees from a common plane locating the aperture axes therein.

The cutter body as described herein supports the cutting tips relative to the mouldboard at an appropriate height and orientation to allow both the blade body 106 and the cutter body 112 to be simultaneously supported at opposing front and rear sides of the lower flange portion 104 of the mouldboard 16.

Figure 6:
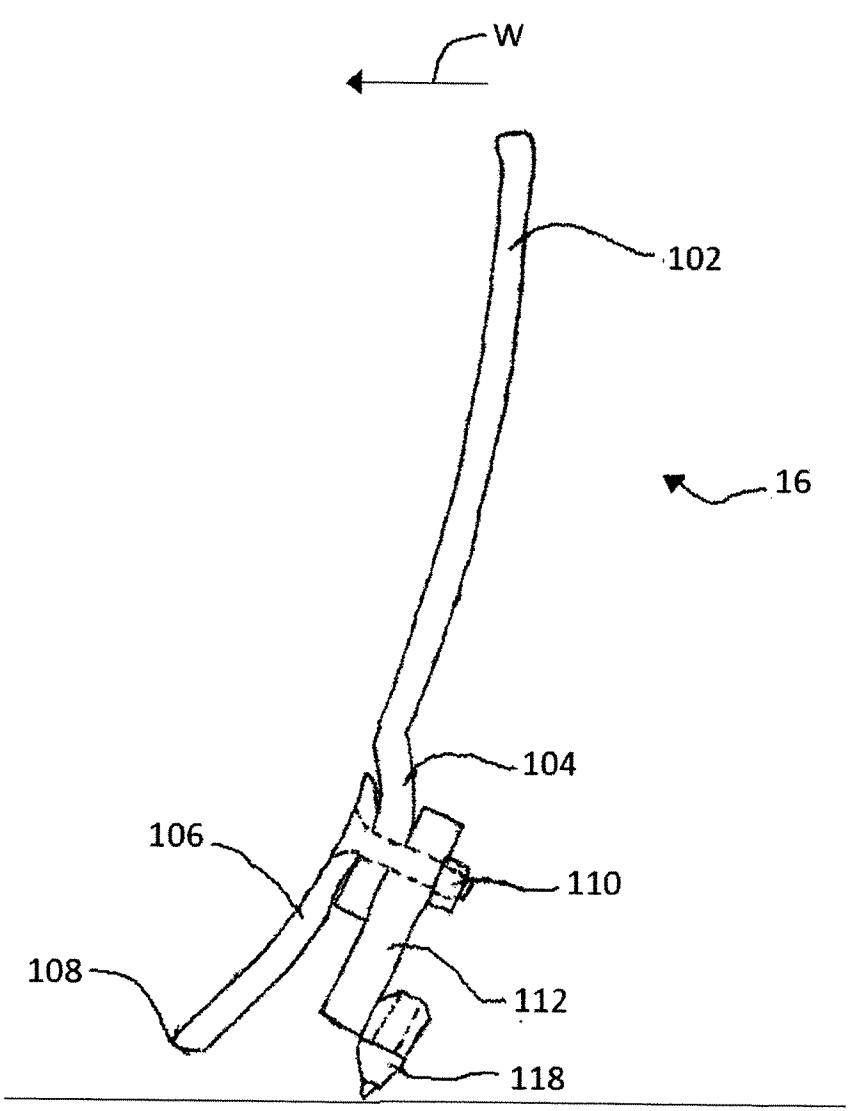
FIG. 6 is a side elevational view of the cutting assembly supported on the mouldboard in a normal cutting position of the cutting assembly according to the first embodiment of FIG. 2.
Figure 5:
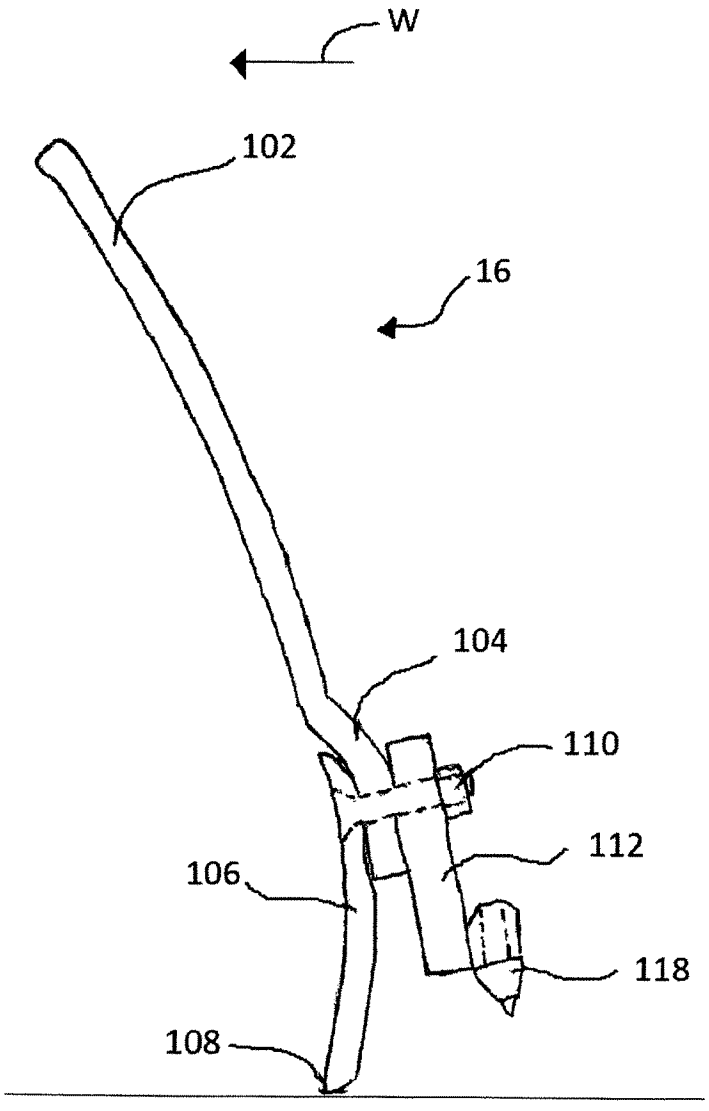
FIG. 5 is a side elevational view of the cutting assembly supported on a mouldboard in the normal working position of the continuous edge blade body according to the first embodiment of FIG. 2.

In use, the mouldboard can be tilted about the tilt axis of the grader between a normal working position as shown in FIG. 5 and a cutting position shown in FIG. 6. As shown in FIGS. 5 and 6, the orientation of the cutting tips on the cutter body 112 and the orientation of the blade body 106 remain fixed relative to the main body 102 in the normal working position compared to the cutting position.

In the normal working position, the blade body is near vertical in orientation and the lower working ends of the cutting tips are greater in elevation than the lower blade edge of the blade body 106.

In the cutting position of FIG. 6, the blade body is sloped upwardly and rearwardly from the lower blade edge thereof such that the lower blade edge has been displaced upwardly and forwardly in relation to the normal working position. This results in the lower working ends of the cutting tips protruding below the lower blade edge of the blade body while the socket axes of the cutting tips are sloped upwardly and rearwardly from the apexes thereof. In this manner the blade body is in an out-of-use position while the cutting tips are arranged for engaging the ground for cutting.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A cutting assembly in combination with a motor grader and cutting tips for mounting on a mouldboard of the motor grader, in which the motor grader includes a frame supported on wheels for rolling movement along the ground in a forward working direction and a mouldboard having (i) a main body that is elongated in a longitudinal direction of the mouldboard and that is tiltable relative to the frame about a tilt axis oriented in the longitudinal direction of the mouldboard such that the tilt axis is transverse to the forward working direction and (ii) a blade body fastened along a lower portion of the main body of the mouldboard, the blade body having a lower blade edge configured for engaging the ground, the cutting assembly comprising:

a cutter body including (i) a forward mounting face mounted along a rear face of the main body of the mouldboard and (ii) fastener apertures receiving fasteners to fasten the cutter body against the rear face of the main body of the mouldboard; and a row of sockets in the cutter body that support the cutting tips respectively therein such that:

(i) the cutting tips are raised relative to the lower blade edge of the blade body in a normal working position of the mouldboard; and (ii) the cutting tips protrude below the lower blade edge of the blade body in a cutting position of the mouldboard in which the lower blade edge of the blade body is tilted about the tilt axis upwardly and forwardly in relation to the normal working position;

wherein displacement of the cutting tips between the normal working position and the cutting position is dependent upon rotation of the mouldboard about the tilt axis of the mouldboard; and wherein the fastener apertures in the cutter body are in alignment with fastener apertures in the main body of the mouldboard and the blade body such that the blade body and the cutter body are mounted onto the main body of the mouldboard using a common set of fasteners.

2. The cutting assembly in combination with the motor grader and the cutting tips according to claim 1 further comprising the sockets being oriented so as to be configured to support the cutting tips raised in elevation relative to the lower blade edge of the blade body when the blade body is substantially vertical in orientation.

3. The cutting assembly in combination with the motor grader and the cutting tips according to claim 1 further comprising the sockets being oriented so as to be configured to support the cutting tips to protrude below the lower blade edge of the blade body when the blade body is sloped upwardly and rearwardly from the lower blade edge thereof.

4. The cutting assembly in combination with the motor grader and the cutting tips according to claim 1 further comprising each socket being configured to receive one of the cutting tips therein along an axis of the socket, and the axis of each socket being oriented at a slope of between 0 degrees and 20 degrees from the forward mounting face of the cutter body.

5. The cutting assembly in combination with the motor grader and the cutting tips according to claim 1 further comprising each socket being configured to receive one of the cutting tips therein along an axis of the socket, and the axis of each socket being oriented at a slope of between 0 degrees and 10 degrees from the forward mounting face of the cutter body.

6. The cutting assembly in combination with the motor grader and the cutting tips according to claim 1 further comprising:

each socket being configured to receive one of the cutting tips therein along an axis of the socket;

each fastener aperture being configured to receive a fastener therein along an axis of the fastener aperture; and the axes of the sockets being oriented at a slope of between 70 degrees and 90 degrees from the axes of the fastener apertures.

7. The cutting assembly in combination with the motor grader and the cutting tips according to claim 1 further comprising:

each socket being configured to receive one of the cutting tips therein along an axis of the socket;

each fastener aperture being configured to receive a fastener therein along an axis of the fastener aperture; and the axes of the sockets being oriented at a slope of between 80 degrees and 90 degrees from the axes of the fastener apertures.

8. The cutting assembly in combination with the motor grader and the cutting tips according to claim 1 wherein each fastener aperture is elongated in a direction transversely to a direction of said row of the sockets.

9. The cutting assembly in combination with the motor grader and the cutting tips according to claim 1 for use with cutting tips each having a sprung retainer member which is resiliently supported on a stem of the cutting tip, wherein each socket includes an annular groove formed therein so as to be configured to receive the sprung retainer member of the respective cutting tip when the stem of the cutting tip is received within the socket to selectively retain the cutting tip within the cutter body.

10. A motor grader comprising:

a frame supported on wheels for rolling movement along the ground in a forward working direction;

a mouldboard having a main body supported on the frame that is elongated in a longitudinal direction of the mouldboard and that is tiltable relative to the frame about a tilt axis oriented in the longitudinal direction of the mouldboard such that the tilt axis is transverse to the forward working direction;

a blade body fastened along a lower portion of the main body of the mouldboard, the blade body having a lower blade edge for engaging the ground;

a cutting assembly comprising:

a cutter body including a forward mounting face mounted along a rear face of the main body of the mouldboard and fastener apertures receiving fasteners therethrough that fasten the cutter body against the rear face of the main body of the mouldboard; and a plurality of cutting tips supported within respective sockets along a row in the cutter body;

the mouldboard being pivotal about the tilt axis between a normal working position and a cutting position of the mouldboard in which the lower blade edge of the blade body is tilted about the tilt axis upwardly and forwardly in relation to the normal working position;

the cutting tips being supported on the cutter body and the cutter body being supported on the mouldboard such that an orientation of the blade body and an orientation of the cutting tips on the cutter body remain fixed relative to the main body in the normal working position relative to the cutting position of the mouldboard; and the cutting tips being supported on the cutter body and the cutter body being the cutting tips being supported on the cutter body and the cutter body being supported on the main body of the mouldboard such that:

(i) the cutting tips are raised relative to the lower blade edge of the blade body in the normal working position of the mouldboard; and (ii) the cutting tips protrude below the lower blade edge of the blade body in the cutting position of the mouldboard;

wherein the fastener apertures in the cutter body are in alignment with fastener apertures in the main body of the mouldboard and the blade body such that the blade body and the cutter body are mounted onto the main body of the mouldboard using a common set of fasteners.

11. The motor grader according to claim 10 further comprising the cutting tips being supported on the cutter body so as to be raised in elevation relative to the lower blade edge of the blade body when the blade body is substantially vertical in orientation.

12. The motor grader according to claim 10 further comprising the cutting tips being supported on the cutter body so as to protrude below the lower blade edge of the blade body when the blade body is sloped upwardly and rearwardly from the lower blade edge thereof.

13. The motor grader according to claim 10 further comprising each socket receiving one of the cutting tips therein along an axis of the socket, and the axis of each socket being oriented at a slope of between 0 degrees and 20 degrees from the forward mounting face of the cutter body.

14. The motor grader according to claim 10 further comprising:

each socket receiving one of the cutting tips therein along an axis of the socket;

each fastener aperture receiving a fastener therein along an axis of the fastener aperture; and the axes of the sockets being oriented at a slope of between 70 degrees and 90 degrees from the axes of the fastener apertures.

15. The motor grader according to claim 10 wherein each fastener aperture is elongated in a direction transversely to a direction of said row of the sockets.

16. The motor grader according to claim 10 wherein the cutting tips each having a sprung retainer member which is resiliently supported on a stem of the cutting tip, and wherein each socket includes an annular groove formed therein which receives the sprung retainer member of the respective cutting tip when the stem of the cutting tip is received within the socket to selectively retain the cutting tip within the cutter body.

17. A method of operating a motor grader including a frame supported on wheels for rolling movement along the ground in forward working direction and a mouldboard having a main body that is elongated in a longitudinal direction of the mouldboard and that is tiltable relative to the frame about a tilt axis oriented in the longitudinal direction of the mouldboard such that the tilt axis is transverse to the forward working direction, the method comprising:

providing a blade body fastened along a lower portion of the main body of the mouldboard at a front side of the main body of the mouldboard such that a lower blade edge of the blade body is configured to engage the ground;

providing a cutter body fastened at a rear side of the main body of the mouldboard, the cutter body including a forward mounting face mounted against a rear face of the main body of the mouldboard in which the cutter body includes fastener apertures in alignment with fastener apertures in the main body of the mouldboard and fastener apertures in the blade body such that a common set of fasteners received within the fastener apertures commonly (i) fasten the cutter body against the rear face of the main body of the mouldboard and (ii) fasten the blade body against the front side of the main body;

providing a plurality of cutting tips supported within respective sockets along a row in the cutter body; and displacing the cutter body between (i) a normal working position in which the cutting tips are raised relative to the lower blade edge of the blade body, and (ii) a cutting position in which the cutting tips protrude below the lower blade edge of the blade body by pivoting of the main body of the mouldboard relative to the frame about the tilt axis.

* * * * *